US010273841B2

(12) United States Patent
Kuroda et al.

(10) Patent No.: US 10,273,841 B2
(45) Date of Patent: Apr. 30, 2019

(54) INTERNAL COMBUSTION ENGINE

(71) Applicant: NISSAN MOTOR CO., LTD., Kanagawa (JP)

(72) Inventors: Masashi Kuroda, Kanagawa (JP); Takashi Tanabe, Kanagawa (JP)

(73) Assignee: Nissan Motor Co., Ltd., Kanagawa (JP)

( * ) Notice: Subject to any disclaimer, the term of this patent is extended or adjusted under 35 U.S.C. 154(b) by 105 days.

(21) Appl. No.: 15/511,883

(22) PCT Filed: Sep. 17, 2014

(86) PCT No.: PCT/JP2014/074463

§ 371 (c)(1),
(2) Date: Mar. 16, 2017

(87) PCT Pub. No.: WO2016/042605

PCT Pub. Date: Mar. 24, 2016

(65) Prior Publication Data

US 2018/0230871 A1 Aug. 16, 2018

(51) Int. Cl.
*F01M 1/08* (2006.01)
*F02D 15/02* (2006.01)
(Continued)

(52) U.S. Cl.
CPC ..... *F01M 1/08* (2013.01); *F01M 1/06* (2013.01); *F01M 9/108* (2013.01); *F01P 3/08* (2013.01);
(Continued)

(58) Field of Classification Search
CPC ..... F01M 1/08; F01M 1/06; F01M 2001/066; F01M 2001/086; F01P 3/08; F01P 7/14;
(Continued)

(56) References Cited

U.S. PATENT DOCUMENTS

2010/0050992 A1* 3/2010 Nakanishi ..... F02B 75/048 123/48 B
2010/0224143 A1* 9/2010 Rabhi ..... F01B 9/047 123/41.39
(Continued)

FOREIGN PATENT DOCUMENTS

JP H05-231419 A 9/1993
JP 2000-240421 A 9/2000
(Continued)

*Primary Examiner* — Syed O Hasan
(74) *Attorney, Agent, or Firm* — Osha Liang LLP

(57) ABSTRACT

An internal combustion engine has a lower link rotatably mounted to a crankpin of a crankshaft, an upper link having a first upper link end rotatably connected to a piston pin of a piston and a second upper link end rotatably connected to a first lower link end side of the lower link through a first connecting pin, and a control link having a first control link end supported on a cylinder block and a second control link end rotatably connected to a second lower link end side of the lower link through a second connecting pin. When viewed in an axial direction of the crankshaft, the second connecting pin is arranged to swing along a lateral direction substantially perpendicular to a center axis of a cylinder of the internal combustion engine.

6 Claims, 5 Drawing Sheets

(51) Int. Cl.

| | |
|---|---|
| ***F01P 3/08*** | (2006.01) |
| ***F02B 75/04*** | (2006.01) |
| ***F01M 9/10*** | (2006.01) |
| ***F01M 1/06*** | (2006.01) |
| *F02B 75/32* | (2006.01) |
| *F01P 7/14* | (2006.01) |

(52) U.S. Cl.
CPC ..... *F01P 7/14* (2013.01); *F02B 75/045* (2013.01); *F02B 75/048* (2013.01); *F02D 15/02* (2013.01); *F01M 2001/066* (2013.01); *F01P 2007/146* (2013.01); *F02B 75/32* (2013.01)

(58) Field of Classification Search
CPC ... F01P 2007/146; F02B 75/04; F02B 75/048; F02D 15/02
USPC ..... 123/48 B
See application file for complete search history.

(56) References Cited

U.S. PATENT DOCUMENTS

| | | | | |
|---|---|---|---|---|
| 2012/0111143 | A1* | 5/2012 | Tanabe ..... | F16C 3/14 74/602 |
| 2014/0053797 | A1* | 2/2014 | Tanabe ..... | F01M 11/02 123/196 CP |

FOREIGN PATENT DOCUMENTS

| | | | |
|---|---|---|---|
| JP | 2003-129817 | A | 5/2003 |
| JP | 2009-524766 | A | 7/2009 |
| JP | 2013-011206 | A | 1/2013 |

* cited by examiner

INTERNAL COMBUSTION ENGINE

BACKGROUND

Field of the Invention

The present invention relates to an internal combustion engine with a multi-link piston-crank mechanism.

Related Art

Patent Document 1 discloses a variable piston stroke type internal combustion engine that includes: a connecting rod connected at an upper end thereof to a piston; an intermediate arm connected at one end thereof to a crankshaft and at the other end thereof to a lower end of the connecting rod; and a control rod having one end connected to the intermediate arm and the other end movably connected as a swing center to a moving mechanism so as to restrict a movement of the intermediate arm and control a stroke amount of the piston.

In Patent Document 1, an oil jet is arranged at a lower end side of a cylinder of the internal combustion engine. This oil jet has a first injection port for injecting engine oil toward the piston and the cylinder and a second injection port for injecting engine oil toward the other-end swing center of the control rod and thus performs the function of cooling and lubricating the piston, the cylinder, the other-end swing-center of the control rod and the moving mechanism.

The so-called multi-link piston-crank mechanism as disclosed in Patent Document 1 is required to maintain an appropriate lubrication state for the purpose of preventing wear and seizing of sliding part on which high load acts.

Although various configurations are proposed for the multi-link piston-crank mechanism, sufficient consideration has not been given as to the lubrication of the sliding part in each of those multi-link piston-crank mechanism configurations. There is still room for improvement in the lubrication of the sliding part in the multi-link piston-crank mechanism.

Patent Document 1: Japanese Laid-Open Patent Publication No. 2003-129817

SUMMARY

According to one or more embodiments of the present invention, there is provided an internal combustion engine, comprising: a lower link rotatably mounted to a crankpin of a crankshaft; an upper link having one end rotatably connected to a piston pin of a piston and the other end rotatably connected to one end side of the lower link through a first connecting pin; a control link having one end supported on a cylinder block and the other end rotatably connected to the other end side of the lower link through a second connecting pin; and an oil jet mounted to a lower part of the cylinder block so as to inject lubricating oil to a back side of the piston, wherein the oil jet has a first injection nozzle that injects the lubricating oil toward the back side of the piston and a second injection nozzle that injects the lubricating oil toward a connection part between the lower link and the control link.

In one or more embodiments of the present invention, the lubricating oil can be supplied continuously from the oil jet. It is therefore possible to increase the amount of the lubricating oil supplied to the sliding part between the second connecting pin and the control link and improve the seizing resistance of the sliding part between the second connecting pin and the control link. It is also possible to suppress the occurrence of heat generation at the sliding part between the second connecting pin and the control link by continuously supplying the lubricating oil from the oil jet as compared with the case of intermittently supplying the lubricating oil from the crankpin through the inside of the lower link.

DETAILED DESCRIPTION

Hereinafter, embodiments of the present invention will be described in detail below with reference to the drawings. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

Figure 1:
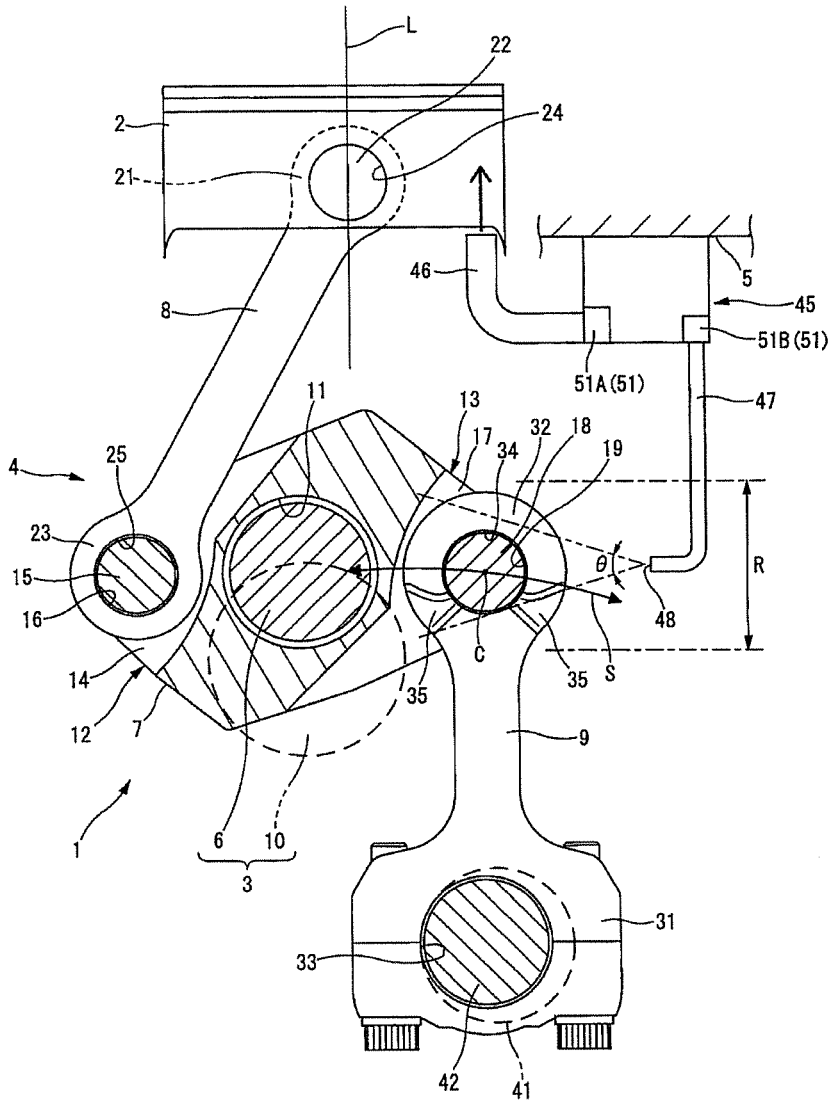
FIG. 1 is a cross-sectional view of an internal combustion engine according to one or more embodiments of the present invention.

FIG. 1 is a schematic view showing a cross section of internal combustion engine 1, as viewed in a crankshaft direction, according to one or more embodiments of the present invention.

Internal combustion engine 1 has multi-link piston-crank mechanism 4 by which piston 2 and crankshaft 3 are linked to each other via a plurality of link members. In one or more embodiments of the present invention, multi-link piston-crank mechanism 4 is configured as a variable compression ratio mechanism to vary an engine compression ratio by changing a top dead center position of piston 2, which reciprocates in a cylinder (not shown) of cylinder block 5.

Multi-link piston-crank mechanism 4 includes: lower link 7 rotatably mounted to crankpin 6 of crankshaft 3; upper link 8 connecting lower link 7 to piston 2; and control link 9 having one end rotatably supported on cylinder block 5 and the other end rotatably connected to lower link 7.

As shown in FIG. 1, crankshaft 3 is disposed below piston 2. The expression "below" as used herein refers to a lower side with respect to an engine vertical direction. In the case of an in-line type internal combustion engine, the engine vertical direction is defined as the direction along a center axis L of the cylinder (see FIG. 1). In the case of a V-type internal combustion engine, the engine vertical direction is defined as the direction along a bank center line that equally divides a bank angle of the engine. The direction along the center axis L of the cylinder is in agreement with a piston reciprocating direction.

Crankshaft 3 has a plurality of journal portions 10 and crankpin 6. Journal portions 10 are rotatably supported on main bearings (not shown) of cylinder block 5. Crankpin 6 is offset by a predetermined amount with respect to journal portions 10. Lower link 7 is rotatably mounted to crankpin 6 as mentioned above.

Figure 2:
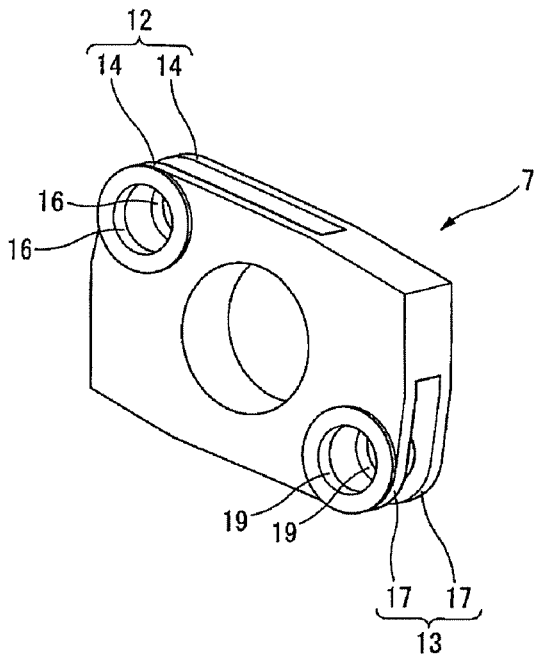
FIG. 2 is a perspective view of a lower link of the internal combustion engine according to one or more embodiments of the present invention.
Figure 3:
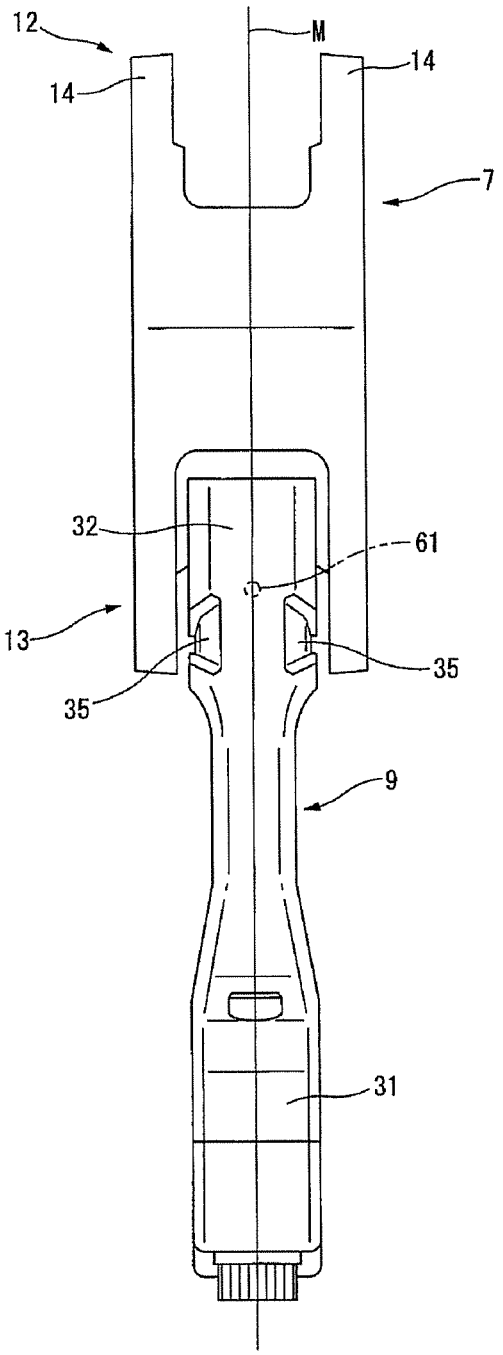
FIG. 3 is a schematic view of the lower link and a control link, as viewed from a direction perpendicular to a crankshaft, of the internal combustion engine according to one or more embodiments of the present invention.

Lower link 7 is disposed below piston 2. As shown in FIGS. 1 to 3, lower link 7 has crankpin bearing portion 11, first-end-side protruding portion 12 located on one first end side of crankpin bearing portion 11 and rotatably connected to the other end of upper link 8 and second-end-side protruding portion 13 located on the other second end side of crankpin bearing portion 11 and rotatably connected to the other end of control link 9.

First-end-side protruding portion 12 is bifurcated in shape, with a pair of first-end-side protruding pieces 14, 14 opposed to each other, so as to hold the other end of upper link 8 from both sides. Lower link first-end-side pin holes 16 are formed in respective first-end-side protruding pieces 14, 14 such that substantially cylindrical column-shaped first connecting pin 15 is fixed by press-fitting in these pin holes 16.

Second-end-side protruding portion 13 is bifurcated in shape, with a pair of second-end-side protruding pieces 17, 17 opposed to each other, so as to hold the other end of control link 9 from both sides. Lower link second-end-side pin holes 19 are formed in respective second-end-side protruding pieces 17, 17 such that substantially cylindrical column-shaped second connecting pin 18 is fixed by press-fitting in these pin holes 19.

Upper link 8 has one-end-side pin boss portion 21 formed on one upper end side thereof and rotatably connected to piston 2 through piston pin 22 and other-end-side pin boss portion 23 formed on the other lower end side thereof and rotatably connected to first-end-side protruding portion 12 of lower link 7 through first connecting pin 15. Namely, piston pin 22 is rotatably inserted in pin hole 24 of upper link one-end-side pin boss portion 21; and first connecting pin 15 is rotatably inserted in pin hole 25 of upper link other-end-side pin boss portion 23.

Control link 9 is arranged along the piston reciprocating direction so as to restrict movement of lower link 7. Control link 9 has one-end-side pin boss portion 31 formed on one lower end side thereof and rotatably connected to eccentric shaft portion 42 of control shaft 41 and other-end-side pin boss portion 32 formed on the other upper end side thereof and rotatably connected to second-end-side protruding portion 13 of lower link 7 through second connecting pin 18. Namely, eccentric shaft portion 42 of control shaft 41 is rotatably inserted in pin hole 33 of control link one-end-side pin boss portion 31; and second connecting pin 18 is rotatably inserted in pin hole 34 of control link other-end-side pin boss portion 32.

A plurality of grooves 35 are formed, in both surfaces of control link other-end-side pin boss portion 32 facing second-end-side protruding portion 13 of lower link 7, so as to continue in a radial direction of control link other-end-side pin boss portion 32. (In one or more embodiments of the present invention, two grooves are formed in each surface of control link other-end-side pin boss portion 32.)

Figure 4:
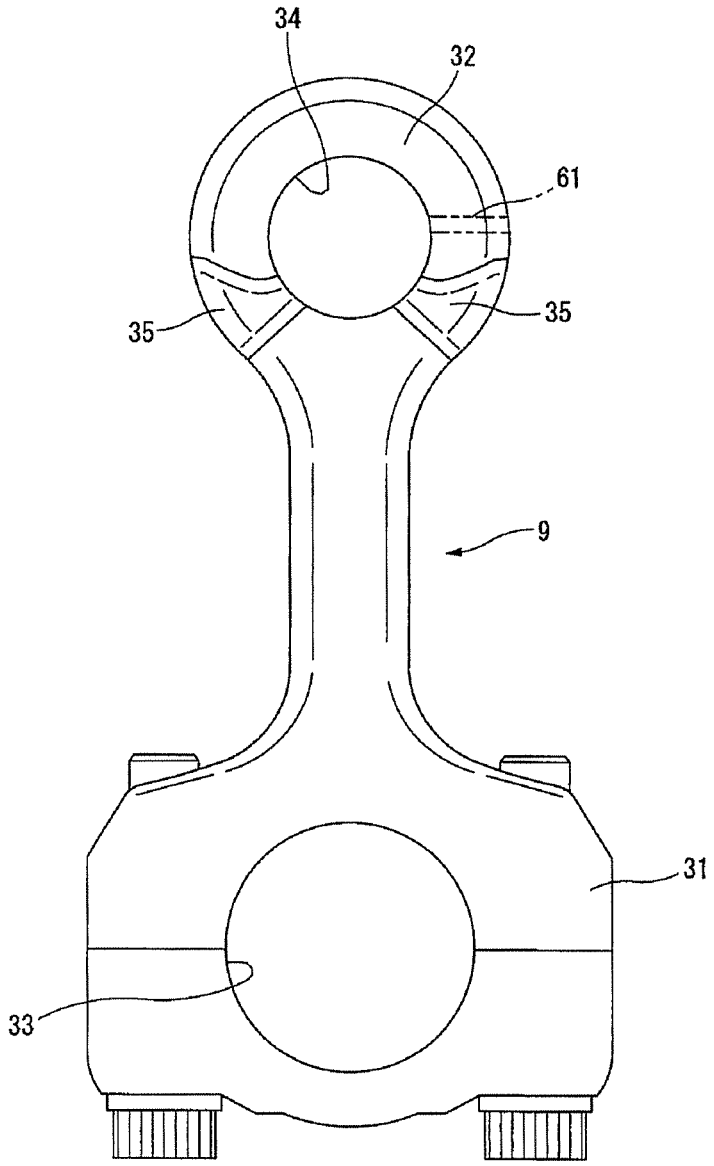
FIG. 4 is an elevation view of the control link of the internal combustion engine according to one or more embodiments of the present invention.

As shown in FIGS. 1, 3 and 4, grooves 35 as a whole are symmetrical when viewed in each of the crankshaft direction and the direction perpendicular to the crankshaft direction.

Control shaft 41 is disposed below crankshaft 3 in parallel to crankshaft 3 and is rotatably supported on cylinder block 5, which constitutes a part of the engine body. Eccentric shaft portion 42 of control shaft 41 is offset with respect to a rotation center of control shaft 41. The one end of control link 9, which is rotatably connected to eccentric shaft portion 42, is thus substantially supported on cylinder block 5.

The rotation position of control shaft 41 is controlled by e.g. a compression ratio control actuator (not shown), which operates based on a control signal from an engine control unit (not shown).

In one or more embodiments of the present invention, crankshaft 3 and control shaft 41 are laterally offset from each other in a state that the cylinder center axis L is in an upright orientation as shown in FIG. 1 and, more specifically, in a state that control shaft 41 is located rightward in FIG. 1 relative to crankshaft 3.

Oil jet 45 for each cylinder is mounted to a lower part of cylinder block 5 so as to inject lubricating oil supplied through pressure control valves 51.

In one or more embodiments of the present invention, oil jet 45 has first injection nozzle 46 that injects the lubricating oil toward the back side of piston 2 during opening of pressure control valve 51A and second injection nozzle 47 that injects the lubricating oil toward the connection part between lower link 7 and control link 9 from the lateral direction of control shaft 9, which is perpendicular to the crankshaft direction, during opening of pressure control valve 51B.

Herein, the "lateral direction of control link 9" is defined as the direction including the cylinder center axis L and perpendicular to a plane parallel to the axis of crankshaft 3. As control link other-end-side pin boss portion 32 is held in bifurcated second-end-side protruding portion 13 of lower link 7, the lubricating oil can be supplied to the connection part between lower link 7 and control link 9 by arranging second injection nozzle 47 in the lateral direction of control link 9 as shown in FIGS. 1 and 3.

Second injection nozzle 47 is in the form of e.g. a full-cone nozzle to inject the lubricating oil at a predetermined spray angle θ. Injection port 48 of second injection nozzle 47 is located within a swing range of second connecting pin 18 in the piston reciprocating direction. In other words, second injection nozzle 47 is arranged such that the position of injection port 48 along the direction of the cylinder center axis L is within the swing range of second connecting pin 18.

Herein, second connecting pin 18 swings substantially laterally along a substantially arc-shaped path in accordance with swing movement of control link 9. This substantially arc-shaped swing path of second connecting pin 18 as a whole changes in position in the direction of the cylinder center axis L as the position of eccentric shaft portion 42 changes with rotation of control shaft 41. The width R of the allowable swing range of second connecting pin 18 in the direction of the cylinder center axis L is relatively small. The lubricating oil can be thus supplied continuously to second connecting pin 18 within the allowable swing range by optimizing the spraying angle size and arrangement position of second injection nozzle 47. In the case where second injection nozzle 47 is arranged at a position within the swing range of second connecting pin 18 in the piston reciprocating direction, according to one or more embodiments of the present invention, it may be preferable that injection port 48 is located at the center of the swing range of second connecting pin 18 in the piston reciprocating direction as shown in FIG. 1.

Further, injection port 48 of second injection nozzle 47 is located at the center of the width of control link 9 in the crankshaft direction. In other words, second injection nozzle 47 is arranged such that injection port 48 is situated over a center line M of control link 9 (see FIG. 3) in the crankshaft direction.

Figure 5:
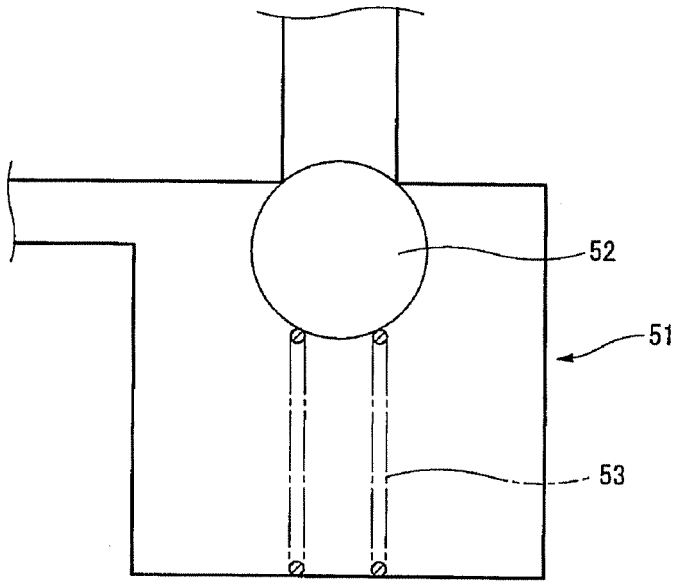
FIG. 5 is a schematic view showing an example of a pressure control valve of the internal combustion engine according to one or more embodiments of the present invention.

As shown in e.g. FIG. 5, each of pressure control valves 51 has valve body 52 and spring member 53 such as coil spring to bias valve body 52.

Figure 6:
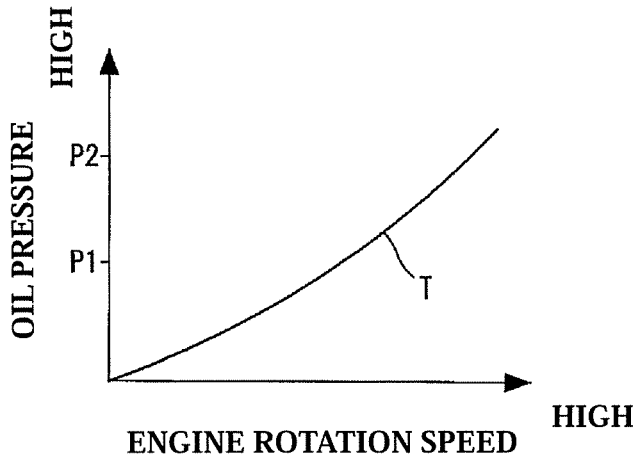
FIG. 6 is a schematic diagram showing a relationship between an engine rotation speed and a supplied oil pressure of the internal combustion engine according to one or more embodiments of the present invention.

FIG. 6 is a schematic diagram showing a relationship between the rotation speed of the engine and the pressure of the lubricating oil supplied to oil jet 45.

The lubricating oil is supplied to oil jet 45 from an oil gallery (not shown) inside cylinder block 5. The pressure of the lubricating oil supplied to oil jet 45 increases with increase in the engine rotation speed as indicated by a characteristic line T in FIG. 6 due to the fact that the lubricating oil pressurized by e.g. an oil pump (not shown), which is driven by internal combustion engine 1, flows in the oil gallery.

In one or more embodiments of the present invention, oil jet 45 is configured to start the injection of the lubricating oil from second injection nozzle 47 after the pressure of the lubricating oil supplied to oil jet 45 becomes relatively high.

More specifically, the injection of the lubricating oil from first injection nozzle 46 is started at a timing when the engine operates at a high load and a certain high rotation speed, i.e., at a timing when the pressure of the lubricating oil reaches a first predetermined oil pressure value P1.

The injection of the lubricating oil from second injection nozzle 47 is then started at a timing when there arises a possibility of seizing at the connection part between second connecting pin 18 and control link 9 due to high thermal load with increase in load and engine rotation speed, i.e., at a timing when the pressure of the lubricating oil reaches a second predetermined oil pressure value P2 higher than the first predetermined oil pressure value P1.

For such oil injection control, the spring constant of spring member 53 by which valve body 52 is biased is set such that pressure control valve 51A is opened when the pressure of the lubricating oil reaches the first predetermined oil pressure value P1 or such that pressure control valve 51B is opened when the pressure of the lubricating oil reaches the second predetermined oil pressure value P2. The oil jet is thus able to start the injection of the lubricating oil from first injection nozzle 46 when the pressure of the lubricating oil reaches the first predetermined oil pressure value P1, and then, start the injection of the lubricating oil from second injection nozzle 47 when the pressure of the lubricating oil reaches the second predetermined oil pressure value P2.

Two pressure control valves 51 may be connected in series. In this case, it is conceivable to connect two pressure control valves 51 such that the lubricating oil from pressure control valve 51 opened at the first predetermined oil pressure value P1 flows into pressure control valve 51 opened at the second predetermined oil pressure value P2, attach first injection nozzle 46 to a lubricating oil passage (not shown) by which two pressure control valves 51 are connected, and then, attach second injection nozzle 47 to a lubricating oil passage (not shown) through which the lubricating oil from pressure control valve 51 opened at the second predetermined oil pressure value P2 flows.

In the above-configured multi-link piston-crank mechanism 4, the connection part between lower link 7 and control link 9 is high in PV value (i.e. product of pressure P and sliding speed V) and susceptible to seizing because the sliding speed of lower link 7 and control link 9 becomes high at a crank angle at which high combustion pressure acts. On the other hand, the connection part between lower link 7 and upper link 8 are low in PV value (i.e. product of pressure P and sliding speed V) and less susceptible to seizing because lower link 7 and upper link 8 are substantially standing still at a crank angle at which high combustion pressure acts.

In the case where: an axial oil passage is formed inside crankshaft 3 along the crankshaft direction; a radial oil passage is formed in crankpin 6 in communication with the axial oil passage; and a lower link second-end-side oil passage is formed inside lower link 7 with one end thereof opening to an inner circumferential surface of crankpin bearing portion 11 at the second end side of lower link 7 and the other end thereof opening to an outer circumferential surface of crankpin bearing portion 11 at the second end side of lower link 7, it is feasible to supply the lubricating oil to the sliding part between second connecting pin 18 and control link other-end-side pin boss portion 32 from crankpin 6 through the inside of lower link 7. In such lubricating oil supply passageway, the lubricating oil is injected toward the sliding part between second connecting pin 18 and control link other-end-side pin boss portion 32 at a timing when the opening of the radial oil passage of crankpin 6 and the opening of the second-end-side oil passage of lower link 7 overlap each other. In other words, the lubricating oil is supplied intermittently to the sliding part between second connecting pin 18 and control link other-end-side pin boss portion 32.

In one or more embodiments of the present invention, oil jet 45, which is used for cooling piston 2, is also used for continuously suppling the lubricating oil to the connection part between lower link 7 and control link 9, i.e., the sliding part between second connecting pin 18 and control link other-end-side pin boss portion 32 in order to particularly prevent the occurrence of seizing at the connection part between lower link 7 and control link 9 in internal combustion engine 1.

It is possible by such continuous oil supply to increase the amount of the lubricating oil supplied to the sliding part between second connecting pin 18 and control link other-end-side pin boss portion 32, as compared with the case of intermittently supplying the lubricating oil from crankpin 6 through the inside of lower link 7, and thereby possible to improve the seizing resistance of second connecting pin 18 and control link other-end-side pin boss portion 32.

As the lubricating oil can be supplied continuously to the sliding part between second connecting pin 18 and control link other-end-side pin boss portion 32, it is possible to efficiently cool the sliding part between second connecting pin 18 and control link other-end-side pin boss portion 32 and suppress the occurrence of heat generation at this sliding part as compared with the case of intermittently supplying the lubricating oil from crankpin 6 through the inside of lower link 7.

Further, grooves 35 are formed in both surfaces of control link other-end-side pin boss portion 32 of control link 9 so that the lubricating oil injected from second injection nozzle 47 of oil jet 45 can be supplied efficiently to the sliding part between second connecting pin 18 and control link other-end-side pin hole 34 through grooves 35. It is namely possible to further improve the seizing resistance of second connecting pin 18 and control link other-end-side pin boss portion 32 by the formation of such grooves 35.

In multi-link piston-crank mechanism 4, the center C of second connecting pin 18 swings as indicated by arrow S in FIG. 1. The swing range of second connecting pin 18 in the piston reciprocating direction is small so that the swing path of second connecting pin 18, when viewed in the crankshaft direction, is substantially in agreement with a half line perpendicular to the cylinder center axis L. Although the swing range of second connecting pin 18 changes in the direction of the cylinder center axis L by the position change of eccentric shaft portion 42 with the rotation of control shaft 41, the width R of such change of the swing range of second connecting pin 18 is relatively small.

Injection port 48 of second injection nozzle 47 is accordingly arranged within the swing range of second connecting pin 18 in the piston reciprocating direction as mentioned above. By this arrangement, the lubricating oil injected from second injection nozzle 47 can be supplied continuously and efficiently to the sliding part between second connecting pin 18 and control link 9 so that it is possible to further improve the seizing resistance and cooling performance of the sliding part between second connecting pin 18 and control link 9.

Furthermore, injection port 48 of second injection nozzle 47 is arranged on the center line M of control link 9 in the crankshaft direction. Even by this arrangement, the lubricating oil injected from second injection nozzle 47 can be supplied continuously and efficiently to the sliding part between second connecting pin 18 and control link 9.

The lubricating oil is not injected from second injection nozzle 47 in an operating region where the pressure of the lubricating oil supplied is lower than the second predetermined oil pressure value P2, i.e., there is no possibility of seizing at the sliding part between second connecting pin 18 and control link other-end-side pin boss portion 32. The lubricating oil is injected from second injection nozzle 47 only in an operating region (high-engine-speed high-load operating region) where the pressure of the lubricating oil supplied is higher than or equal to the second predetermined oil pressure value P2, i.e., there arises a possibility of seizing at the sliding part between second connecting pin 18 and control link other-end-side pin boss portion 32. It is possible by such injection control to reduce the driving friction of the oil pump that supplies the lubricating oil to oil jet 45.

Instead of grooves 35, control link other-end-side pin boss portion 32 may have faulted therein through hole 61 opening at one end thereof to an outer circumferential surface of control link other-end-side pin boss portion 32 and at the other end thereof to an inner circumferential surface of control link other-end-side pin hole 34 as indicated by broken lines in FIGS. 3 and 4, such that the lubricating oil injected from second injection nozzle 47 of oil jet 45 can be supplied to the sliding part between second connecting pin 18 and control link other-end-side pin boss portion 32 through though hole 61. In this case, through hole 61 is situated at substantially the center of control link other-end-side pin boss portion 32 in the piston reciprocating direction and, at the same time, over the center line M of control link 9 (see FIG. 3) in the crankshaft direction.

Although multi-link piston-crank mechanism 4 is configured as the variable compression ratio mechanism in one or more of the above embodiments, one or more embodiments of the present invention is applicable to the case of any multi-link piston-crank mechanism other than the variable compression ratio mechanism. In this case, the configuration of the multi-link piston-crank mechanism is substantially similar to that of multi-link piston-crank mechanism 4 but is different in that: control shaft 41 is provided with no eccentric shaft portion 42; and control link 9 is rotatably connected at one end thereof to control shaft 41.

The lubricating oil may be supplied not only from the oil jet to the connection part between second connecting pin 18 and the other end of control link 9 but also from crankpin 6 through the inside of lower link 7. In this case, it is conceivable to form an axial oil passage in crankshaft 3 along the crankshaft direction, form a radial oil passage in crankpin 6 in communication with the axial oil passage, and then, form a lower link oil passage in lower link 7 with one end thereof opening to an inner circumferential surface of crankpin bearing portion 11 of lower link 7 and the other end thereof opening to an outer circumferential surface of crankpin bearing portion 11 of lower link 7.

In one or more of the above embodiments, the second end side of lower link 7 is adapted as bifurcated protruding portion 13 such that control link other-end-side pin boss portion 32 can be held from both sides by bifurcated second-end-side protruding portion 13. The other end side of control link 9, rather than the second end side of lower link 7, may alternatively be bifurcated in shape so as to hold the second-end-side protruding portion of lower link 7 from both sides.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. An internal combustion engine, comprising:

a lower link rotatably mounted to a crankpin of a crankshaft;

an upper link having a first upper link end rotatably connected to a piston pin of a piston and a second upper link end rotatably connected to a first lower link end side of the lower link through a first connecting pin; and a control link having a first control link end supported on a cylinder block and a second control link end rotatably connected to a second lower link end side of the lower link through a second connecting pin, wherein, when viewed in an axial direction of the crankshaft, the second connecting pin is arranged to swing along a lateral direction substantially perpendicular to a center axis of a cylinder of the internal combustion engine, wherein the internal combustion engine further comprises an oil jet mounted to the cylinder block, and wherein the oil jet comprises:

a first injection nozzle equipped with a first pressure control valve to inject lubricating oil towards a back side of the piston, and a second injection nozzle equipped with a second pressure control valve to inject lubricating oil toward a connection part between the lower link and the control link from the lateral direction.

2. The internal combustion engine according to claim 1, wherein the lower link is disposed below the piston, wherein the control link is arranged along a reciprocating direction of the piston, with the second control link end of the control link being supported on the cylinder block at a position below the lower link, and wherein the second injection nozzle comprises an injection port located within a swing range of the second connecting pin in the reciprocating direction of the piston and at the center of a width of the control link in the axial direction of the crankshaft.

3. The internal combustion engine according to claim 1, wherein the lower link comprises a bifurcated protruding portion configured to hold the second control link end of the control link from both sides, and wherein the second control link end of the control link comprises grooves formed in both sides thereof facing the bifurcated protruding portion of the lower link, such that the lubricating oil injected from the second injection nozzle is supplied to a sliding part between the second connecting pin and the control link through the grooves.

4. The internal combustion engine according to claim 1, wherein the oil jet allows injection of the lubricating oil from either of the first and second injection nozzles in accordance with a pressure of the lubricating oil supplied to the oil jet, and wherein the injection of the lubricating oil from the second injection nozzle is started when the pressure of the lubricating oil supplied to the oil jet becomes higher than a pressure value at which the injection of the lubricating oil from the first injection nozzle is started.

5. An internal combustion engine, comprising:

a lower link rotatably mounted to a crankpin of a crankshaft;

an upper link having a first upper link end rotatably connected to a piston pin of a piston and a second upper link end rotatably connected to a first lower link end side of the lower link through a first connecting pin; and a control link having a first control link end supported on a cylinder block and a second control link end rotatably connected to a second lower link end side of the lower link through a second connecting pin, wherein, when viewed in an axial direction of the crankshaft, the second connecting pin is arranged to swing along a lateral direction substantially perpendicular to a center axis of a cylinder of the internal combustion engine, wherein the internal combustion engine further comprises an oil jet that injects lubricating oil toward a connection part between the lower link and the control link from the lateral direction, wherein the oil jet comprises:

a first injection nozzle that injects the lubricating oil toward a back side of the piston, and a second injection nozzle that injects the lubricating oil toward the connection part between the lower link and the control link, wherein the lower link is disposed below the piston, wherein the control link is arranged along a reciprocating direction of the piston, with the second control link end of the control link being supported on the cylinder block at a position below the lower link, and wherein the second injection nozzle comprises an injection port located within a swing range of the second connecting pin in the reciprocating direction of the piston and at the center of a width of the control link in the axial direction of the crankshaft.

6. An internal combustion engine, comprising:

a lower link rotatably mounted to a crankpin of a crankshaft;

an upper link having a first upper link end rotatably connected to a piston pin of a piston and a second upper link end rotatably connected to a first lower link end side of the lower link through a first connecting pin; and a control link having a first control link end supported on a cylinder block and a second control link end rotatably connected to a second lower link end side of the lower link through a second connecting pin, wherein, when viewed in an axial direction of the crankshaft, the second connecting pin is arranged to swing along a lateral direction substantially perpendicular to a center axis of a cylinder of the internal combustion engine, wherein the internal combustion engine further comprises an oil jet that injects lubricating oil toward a connection part between the lower link and the control link from the lateral direction, wherein the oil jet comprises:

a first injection nozzle that injects the lubricating oil toward a back side of the piston, and a second injection nozzle that injects the lubricating oil toward the connection part between the lower link and the control link, wherein the lower link comprises a bifurcated protruding portion configured to hold the second control link end of the control link from both sides, and wherein the second control link end of the control link comprises grooves formed in both sides thereof facing the bifurcated protruding portion of the lower link, such that the lubricating oil injected from the second injection nozzle is supplied to a sliding part between the second connecting pin and the control link through the grooves.

* * * * *